US009464388B1

(12) United States Patent
Sternberg et al.

(10) Patent No.: US 9,464,388 B1
(45) Date of Patent: Oct. 11, 2016

(54) MODULAR TURF SYSTEM AND METHOD OF TURF INSTALLATION

(75) Inventors: David J. Sternberg, Schaumburg, IL (US); Thomas G. Lober, Schaumburg, IL (US); Matthew V. Scavo, Chicago, IL (US)

(73) Assignee: Perfect Tuff LLC, Schaumburg, IL (US)

( * ) Notice: Subject to any disclaimer, the term of this patent is extended or adjusted under 35 U.S.C. 154(b) by 712 days.

(21) Appl. No.: 13/419,310

(22) Filed: Mar. 13, 2012

(51) Int. Cl.
*E01C 13/08* (2006.01)
*E01C 11/22* (2006.01)

(52) U.S. Cl.
CPC ..... *E01C 13/08* (2013.01); *E01C 11/225* (2013.01)

(58) Field of Classification Search
CPC .. E01C 13/08; E01C 2013/006; E01C 13/04; E01C 13/045; E01C 11/225; E01C 2201/12; E01C 2201/14; E01C 2201/16
USPC ..... 428/17, 44, 47, 48, 51
See application file for complete search history.

(56) References Cited

U.S. PATENT DOCUMENTS 3,735,988 A * 5/1973 Palmer ..... A63B 67/02 428/17
3,752,121 A * 8/1973 Brazzell ..... A01K 1/0107 119/169
4,902,540 A * 2/1990 Martino ..... A63B 69/3661 427/389.9
5,292,130 A * 3/1994 Hooper ..... A63B 69/3661 15/216
6,156,396 A * 12/2000 Florian ..... A63B 69/3661 428/17
6,746,340 B1 * 6/2004 Dover ..... A63B 69/3661 473/278
7,155,796 B2 * 1/2007 Cook ..... 29/428
7,273,642 B2 * 9/2007 Prevost ..... 428/17
7,549,932 B1 * 6/2009 Miyamoto ..... A63B 69/3661 473/278
8,303,430 B2 * 11/2012 Li ..... A63B 69/3661 473/278
8,329,265 B2 * 12/2012 Cook ..... 428/17
8,623,487 B2 * 1/2014 Murphy ..... A01G 1/002 428/17
9,267,244 B2 * 2/2016 Bennett ..... E01C 13/08
2004/0058096 A1 * 3/2004 Prevost ..... 428/17
2005/0028475 A1 * 2/2005 Barlow et al. ..... 52/578
2005/0158482 A1 * 7/2005 Cook ..... E01C 13/08 428/17
2005/0284392 A1 * 12/2005 Hillman ..... A01K 1/011 119/169
2007/0101566 A1 * 5/2007 Cook ..... 29/428
2007/0155526 A1 * 7/2007 McFarlin ..... A63B 69/3661 473/278

(Continued)

FOREIGN PATENT DOCUMENTS

JP 2000239923 A * 9/2000

*Primary Examiner* — Cheryl Juska
(74) *Attorney, Agent, or Firm* — Charles T. Riggs, Jr.

(57) ABSTRACT

The present subject matter relates to a method and system for synthetic turf and the installation thereof. Modular turf sections are formed by attaching a turf section to a corresponding base structure of any desired size and shape. The base section has smooth edges, and can be cut to any desired shape, angle or cutout. The modular turf sections are laid side by side to cover a surface having any size and shape. The modular turf sections are portable and can be individually lifted after having been installed, thereby allowing for cleaning, repair and/or access under one or more selected modular turf sections, or for the replacement of selected modular turf sections which become worn or damaged.

7 Claims, 4 Drawing Sheets

(56) References Cited

U.S. PATENT DOCUMENTS

2007/0293338 A1* 12/2007 McFarlin ..... A63B 69/3623 473/278
2008/0251026 A1* 10/2008 Bell ..... A01K 1/0125 119/168
2009/0004409 A1* 1/2009 McCoy ..... A01K 1/0353 428/17
2009/0208674 A1* 8/2009 Murphy et al. ..... 428/17
2010/0055461 A1* 3/2010 Daluise et al. ..... 428/403
2011/0095563 A1* 4/2011 Andersen ..... B62D 35/02 296/180.1
2012/0118241 A1* 5/2012 Smith, II ..... A01K 1/0107 119/167
2012/0258811 A1* 10/2012 Tetrault et al. ..... 472/92
2013/0298840 A1* 11/2013 Mishan ..... A01K 1/0107 119/165
2014/0102375 A1* 4/2014 Feld ..... A01G 1/007 119/165
2014/0115999 A1* 5/2014 Murphy ..... A01G 1/002 52/741.1
2014/0158060 A1* 6/2014 Martin ..... A01K 1/0107 119/169
2014/0299068 A1* 10/2014 Kupka ..... A01K 1/0107 119/501
2015/0059653 A1* 3/2015 Martin ..... A01K 1/0107 119/161

* cited by examiner

Figure 1
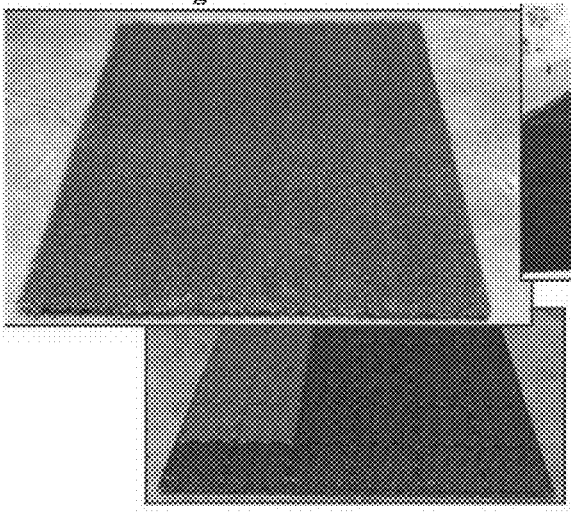
Figure 2
Figure 3
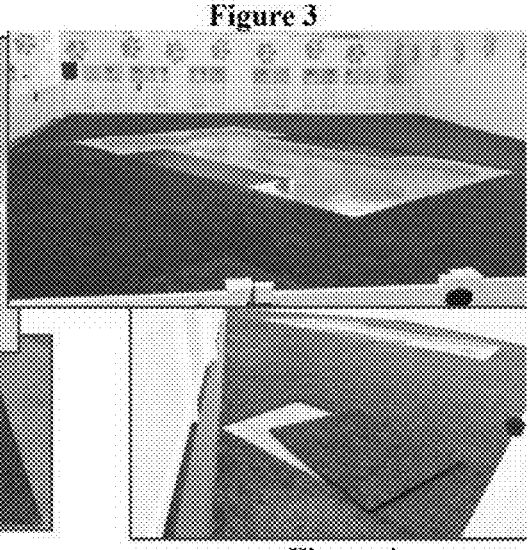
Figure 4
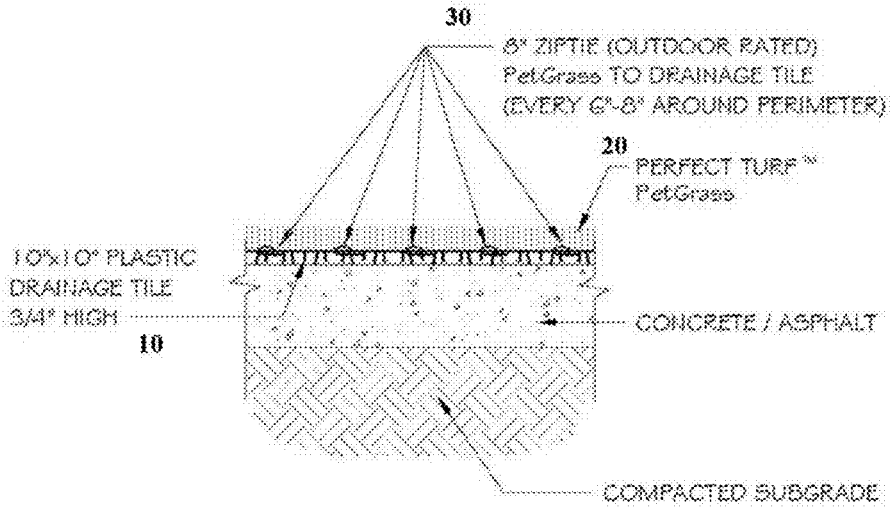
DETAIL - SYNTHETIC TURF
OVER CONCRETE / ASPHALT BASE
Figure 5

MODULAR TURF SYSTEM AND METHOD OF TURF INSTALLATION

TECHNICAL FIELD

The exemplary teachings herein pertain to methods and systems relating to synthetic turf and the installation thereof. The present disclosure relates generally to a modular turf system, and method of constructing and installing the modular turf system. In particular, the present disclosure relates to modular, self-contained sections of turf customizable to any size and shape, which provides flexibility and adjustability in both installation and maintenance. Specifically, the present disclosure relates to modular turf sections comprised of synthetic turf secured to a base structure, and installed side by side on any type of surface defining any area of any size and/or shape.

BACKGROUND

In a traditional synthetic turf installation, a base of stone, concrete or other material is laid over the area on which the turf is being installed. Rolls of synthetic turf are then spread out over the base layer, seamed together, and suitably anchored along the perimeter of the installation area. This results in one continuous, carpet-like layer of turf covering the entire area. However, such a turf installation can be time consuming and labor intensive, and difficult to seam, anchor or otherwise install within the parameters of a specified location. Further, the uniform rolls of turf can be inflexible in design or impractical for a particular use in a particular location, and must usually be professionally installed.

In the case of an indoor installation, for example, a base is typically constructed using plastic drainage tiles, similar to a landscape drainage tile having a plurality of triangular or other shaped openings, arranged to cover the entire area of installation. Once this base is constructed, installation of the turf proceeds as described above, with rolls of turf spread out over the base layer, seamed together, and suitably anchored along the perimeter of the installation area. This again results in one continuous, carpet-like layer of turf covering the entire area. Again, such a turf installation can be time consuming and labor intensive, and difficult to seam, anchor or otherwise install within the parameters of a specified location.

Once installed, the turf may be cleaned to a certain extent by rinsing with water from a hose, or lightly scrubbing with a brush and cleaning solution. However, it is not possible with such installations to clean under the carpet of synthetic turf or under the tile base, or to make repairs to or access the surface below the turf or tile base. Further, should certain areas of the carpet of turf become worn, faded, torn or otherwise damaged, the entire carpet of turf, or large sections thereof, would typically have to be replaced.

Accordingly, there is a need in the synthetic turf industry for a turf system and method of installation which is flexible in design for any location having any sized or shaped area, which is quick and easy to install in any desired configuration, and which allows for cleaning, repairs or access under the surface of the turf or turf base. The exemplary teachings herein fulfill such needs, and provide numerous other benefits and advantages in the industry. It is desired that the methods and systems for providing the above benefits be applicable to any instances or applications wherein synthetic turf or other types of porous floor coverings such as indoor/outdoor carpeting are to be installed over a surface area of any shape or size.

SUMMARY

The exemplary technique(s), system(s) and method(s) presented herein relate to a modular turf system and method of turf installation, and in particular for the customizable installation of modular turf sections which can be selectively removed and/or replaced in a modular fashion. The exemplary method and system include utilizing a base structure of a desired size and shape, having a corresponding turf section suitably attached atop the base structure to form the modular turf section. The edges of the base structure are preferably smooth, allowing adjacent modular sections to abut up against and lie evenly next to each other, resulting in a uniform or continuous appearance.

In use, the modular turf sections are simply laid side by side in a continuous fashion until the entire surface of the desired area is covered. The modular turf sections can easily be trimmed or cut to any desired size or shape, to accommodate for different sized or shaped areas, or to install around obstacles on or in the surface of the area being covered. In this manner, installation is quick and easy and can be accomplished by non-professionals. Further, the modular system and installation allows any single modular turf section to be replaced if damaged, or removed and cleaned under and placed back into its original position.

Additional objects, advantages and novel features will be set forth in part in the description which follows, and in part will become apparent to those skilled in the art upon examination of the following and the accompanying drawings or may be learned by production or operation of the examples or teachings herein.

BRIEF DESCRIPTION OF THE DRAWINGS

The drawing figures depict one or more implementations in accord with the present teachings, by way of example only, not by way of limitation. In the drawing figures, like reference numerals refer to the same or similar elements.

FIG. 1 illustrates a perspective view of a single modular turf section;

FIG. 2 is a perspective view of the base structure of the modular turf section of FIG. 1;

FIG. 3 is a perspective view of a plurality of modular turf sections having been installed in a defined area;

FIG. 4 is a perspective view of the installed modular turf sections of FIG. 3, with one of the modular turf sections having been removed or displaced;

FIG. 5 is a schematic cross-section view of a modular turf section placed on a surface;

DETAILED DESCRIPTION

Figure 6:
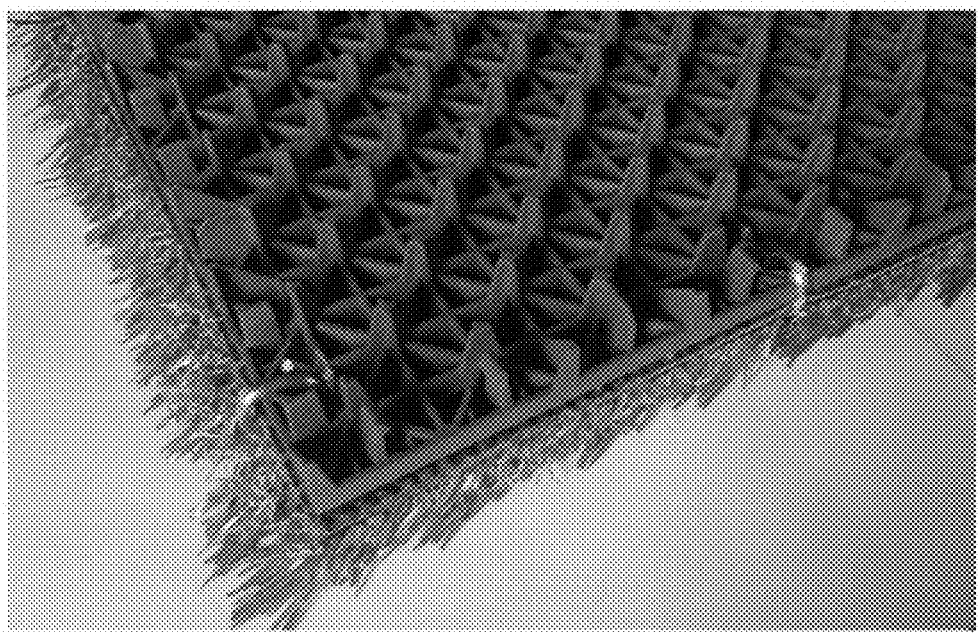
FIG. 6 is an enlarged bottom perspective view of a corner of a modular turf section.

The following description refers to numerous specific details which are set forth by way of examples to provide a thorough understanding of the relevant teachings. It should be apparent to those skilled in the art that the present teachings may be practiced without such details. In other instances, well known methods, procedures, and components have been described at a relatively high-level, without detail, in order to avoid unnecessarily obscuring aspects of the present teachings. While the description refers by way of example to synthetic turf, is should be understood that the method(s) and system(s) described herein may be used for any similar type of surface coverings, and for application in any location having any size and shape.

FIG. 1 is perspective view illustrating a single modular turf section. The modular turf section comprises a base structure of a predetermined size and shape, and a corresponding turf section having the same or substantially similar size and shape as the base structure. The turf section is secured to the base section in any suitable manner, such as by hog rings or plastic zip ties, as described in more detail below.

FIG. 2 is a perspective view illustrating the base structure of the modular turf section of FIG. 1. The base structure can take any desired size and shape. The base structure can also be made from any suitable material, preferably from a rigid or semi-rigid plastic material. Other suitable material such as a metal or treated wood or composite laminate is contemplated. Further, the base structure can be a single, continuous piece, or it can be assembled from a plurality of interlocking tiles. For example, the base structure can be made from commercially available VersaCourt™ tiles from VersaCourt International, Inc. of Lamar, Mo.

FIG. 3 is a perspective view illustrating a plurality of modular turf sections having been installed in a defined area, for example an indoor dog care facility. The modular turf sections are laid side by side, adjacent to and abutting each other. As such, the turf appears carpet-like, as if it where one continuous, uniform piece of turf.

FIG. 4 is a perspective view illustrating the installed modular turf sections of FIG. 3, with one of the modular turf sections having been removed or displaced. As can be seen, the turf sections can simply be lifted out of place individually, and can simply be put back in place or replaced with a new modular turf section of the same size and shape. This allows any or all of the modular turf sections to be cleaned under. This also allows any or all of the modular turf sections to be selectively replaced individually if worn or damaged. This can result in significant cost savings, as well as time and labor.

As can be seen in FIG. 4, the modular turf section located above the displaced section has been cut on a diagonal, thereby allowing the modular turf system to conform to the shape of the perimeter of the area being covered by the turf. It should thus be understood that the modular turf sections can be cut to any desired size or shape, using a circular saw, a jig saw or any other suitable cutting tool. Circular, semi-circular, slotted or other shaped cutouts can also be made so that the modular turf sections can be installed around existing obstacles on or in the surface being covered with turf, such as for example a flap pole.

FIG. 5 illustrates a schematic cross-section view of a modular turf section placed on a surface. As can be seen, the modular turf section comprises a modular base structure 10, to which a corresponding sized and shaped section of synthetic turf 20 is secured along the edges thereof via suitable fasteners 30. As illustrated, the fasteners are outdoor rated zip ties. However, it should be understood that any suitable fasteners may be used, for example, staples, clips, clamps, wires or the like. In a preferred embodiment, metal hog rings are formed around the edges of the turf and the base structure using a commercially available hog ring tool. Preferably, the fasteners are located approximately every six to eight inches around the perimeter of the modular turf section, however, this distance can vary depending on preference and the amount and nature of use or traffic on the turf.

FIG. 6 illustrates an enlarged bottom perspective view of a corner of a modular turf section. In this figure, the modular turf section is shown upside down, revealing the bottom of the base structure, and the bottom of the synthetic turf attached thereto via the hog rings (two shown). As can be seen, the edges of the base structure are smooth, allowing adjacent base structures to lie flat up against the edges without any gap being formed. The base structure is formed with a plurality of openings thereby allowing liquids and small particles to pass through to the surface below. The backing of the synthetic turf also has a plurality of opening or small holes for allowing liquid and small particles to pass through to the base structure and then continuing to the surface below. This combination allows for excellent drainage and an aeration layer allowing the turf and the floor surface to dry. Alternatively, the turf can have a permeable or flow-through backing without holes, allowing liquid to pass through unobstructed.

In one embodiment, such as use in an indoor dog care facility, the synthetic turf preferably comprises commercially available PetGrass™ synthetic turf from Perfect Turf LLC of Schaumburg, Ill. This turf comprises antimicrobial agents built into the yarn and backing of the turf to help eliminate odors and keep it sanitary. Accordingly, the modular turf sections can be easily rinsed or scrubbed, and then allowed to dry, and can be lifted individually to scrub or clean the surface below the modular turf sections. Other types of synthetic turf can be used in other applications such as outdoor turf for covering old or damaged surfaces such as patios or decks.

FIGS. 7A-7I illustrate the method of making a modular turf section. The modular turf sections can be made in any size. For example, a standard size modular turf section could measure forty inches by fifty inches. The base structure for such a standard sized modular turf section could be one single, continuous piece. Alternatively, the modular base structure can be constructed from a plurality of smaller snap-together tiles, such as square tiles measuring ten inches by ten inches. In this manner, the modular turf sections can be customized to any size. For example, a forty inch by sixty inch modular turf section could be made from twenty-four such square tiles arranged in a four tile by six tile rectangle.

Figure 7A:
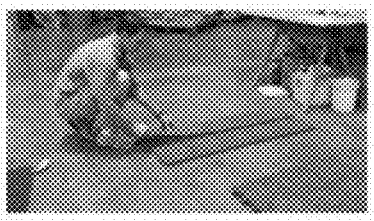
FIGS. 7A-7I illustrate the method of making a modular turf section.
Figure 7B:
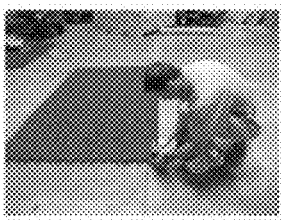
Figure 7C:
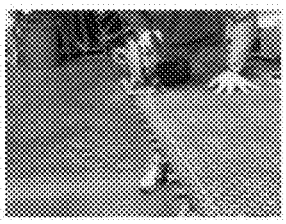

Accordingly, to make a custom sized modular turf section, the desired number of tiles are arranged in the desired shape and snapped together by their complementary connectors formed along the edge thereof, as illustrated in FIGS. 7A and 7B. If necessary, the assembled base structure is then cut to a desired size using a power saw as illustrated in FIG. 7C. Any suitable angles, slots or holes may also be cut at this time. Also, any connectors extending from the outer edge of an assembled base structure would be cut off as well.

Figure 7D:
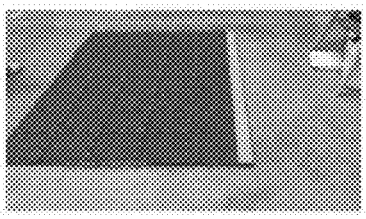
Figure 7E:
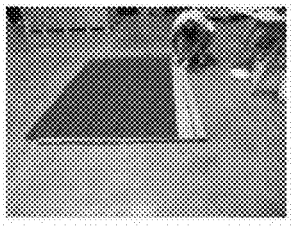
Figure 7F:
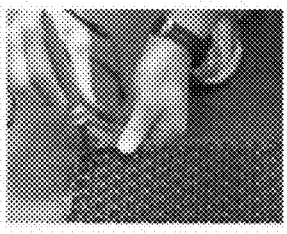

Once the base structure is formed to the desired size, the corresponding turf section is then cut, if necessary, to the same size as the base structure. This can be done by laying the upside down base structure on top of the upside down turf section, and then running a cutting tool along the edges of the base structure, as illustrated in FIGS. 7D and 7E. Thereafter, if existing holes in the backing of the turf are not aligned closely with the edges of the base structure, new holes can be created for receiving plastic zip ties fastened manually. As shown in FIG. 7F, new holes can be formed in the turf using any suitable tool such as a soldering iron, drill, Dremel tool, awl, nail, or any hole forming implement. However, it is not necessary to form new holes when a pneumatic hog ring tool is used to fasten hogs rings thereto.

Figure 7G:
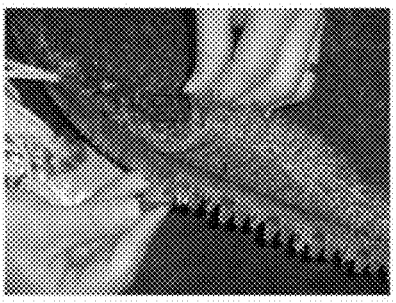
Figure 7H:
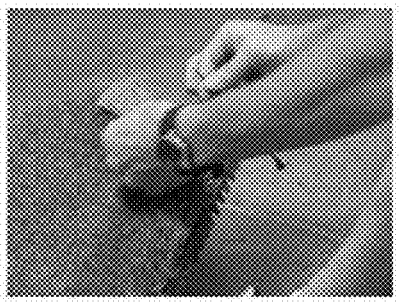
Figure 7I:
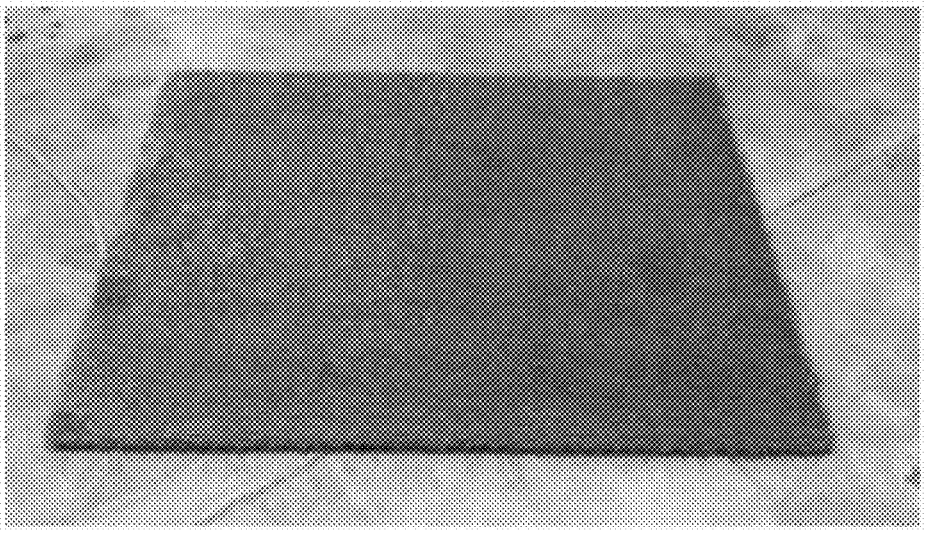

To fasten the turf section to the base structure, the turf section and base structure are preferably positioned upright, and the edges lifted by hand or otherwise exposed to allow the fasteners to be inserted there around. If zip ties are used, it is preferred to insert the zip tie from the bottom, as illustrated in FIGS. 7G and 7H. Once the fasteners are in place, any turf fibers trapped under the fasteners can be pulled out from under the fasteners such that the fasteners will be below the level of the turf fibers and buried within the turf so as not to be noticeable in the finished modular turf section, as illustrated in FIG. 7I.

The finished modular turf sections can then be installed side by side to cover the desired surface area (as illustrated in FIGS. 3 and 4). The walls or other structure defining the perimeter of the area of installation serve to prevent the modular turf sections from sliding or from otherwise undesired movement relative to each other. Nonetheless, if the modular turf sections will be used in an unbounded area and will receive excessive forces which could cause movement thereof, the edges of adjacent modular turf sections can be fastened together by any suitable clamps, clips, ties, tapes or other suitable fasteners. Alternatively, the modular turf sections can be installed upon a non-slip surface such as a carpet-like rubber mat, or a non-slip coating or pad can be applied to or affixed to the bottom feet of the base structure. Further, suitable step rails, brackets or tapered edging can be attached to or located against the free edges of the modular turf sections and secured to the floor when necessary to provide a smooth transition from the ground surface to the top of the modular turf sections and to prevent movement thereof. Such step rails, brackets or tapered edging could also form a boundary for the modular turf system.

Figure 8:
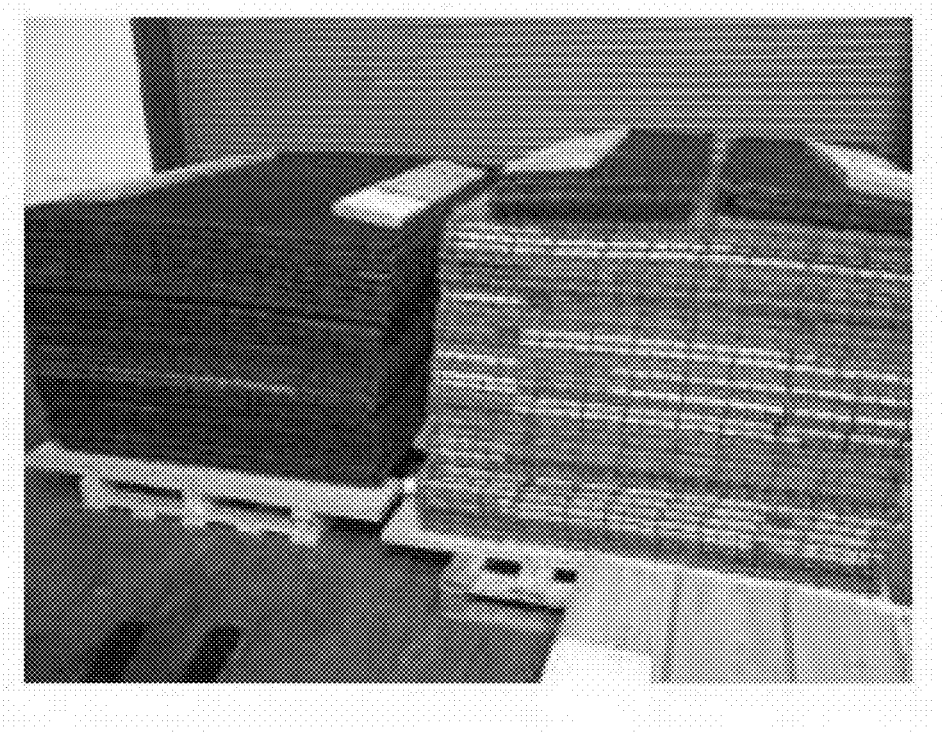
FIG. 8 is a perspective view of the modular turf sections stacked on pallets for storage and/or shipping.

The modular turf sections can easily be installed relatively quickly by non-professionals or do-it-yourselfers, resulting in substantial time and cost savings. Further, the modular turf sections are portable, allowing them to be moved from and to any installation site desired, thereby allowing for a temporary installation if desired. The modular turf sections also result in an easier and more convenient shipping method, as they can simply be stacked upon pallets for storage and/or shipping, as illustrated in FIG. 8.

While the foregoing discussion presents the teachings in an exemplary fashion with respect to the disclosed method and system for a modular turf system and method of turf installation, it will be apparent to those skilled in the art that the teachings may apply to any type of modular or portable turf system, customizable to any size and shape area. Further, while the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

What is claimed is:

1. A modular turf section for installation adjacent to one or more additional modular turf sections within a defined area, consisting of:

a base structure having a customizable size and shape, wherein the base structure includes a plurality of openings allowing liquids to pass therethrough;

a turf section of a size and shape equal to the size and shape of the base structure, wherein the turf section consists of synthetic turf fibers and a permeable backing; and one or more fasteners for securing the turf section to the base structure;

wherein the modular turf section is portable and individually liftable by hand after having been installed, thereby allowing for cleaning, repair, replacement and/or access under the modular turf section.

2. The modular turf section of claim 1, wherein the synthetic turf and backing further include antimicrobial agents.

3. A modular turf system for installation within a defined area, comprising:

a plurality of modular turf sections, each comprising a base structure having a customizable size and shape, and a turf section of equal size and shape attached thereto, wherein the base structure includes a plurality of openings allowing liquids to pass therethrough, and wherein the turf section consists of synthetic turf fibers and a permeable backing;

wherein the modular turf sections have smooth edges allowing adjacent base structures to lie flat next to each other and abut up against the edges of adjacent base structures without any gap being formed; and wherein the modular turf sections are placed side by side to cover the defined area;

wherein the modular turf sections are portable and individually liftable by hand after having been installed, thereby allowing for cleaning, repair, replacement and/or access under one or more selected modular turf sections.

4. The system of claim 3, wherein angles or cutouts are formed in one or more modular turf sections to conform to the desired surface area.

5. The system of claim 3, wherein the synthetic turf and backing further include antimicrobial agents.

6. A method of synthetic turf installation, comprising the steps of:

defining an installation area;

forming a plurality of base structures having a customizable size and shape, wherein each of the base structures includes a plurality of openings allowing liquids to pass therethrough, and;

cutting one or more of the plurality of base structures so that the area of the plurality of base structures corresponds to the area of the installation area;

cutting a plurality of turf sections each having a size and shape equal to one of the plurality of base structures, wherein each turf section consists of synthetic turf fibers and a permeable backing;

attaching each turf section to a corresponding base structure having an equal size and shape to form a plurality of portable modular turf sections, wherein the modular turf sections have smooth edges allowing adjacent base structures to lie flat next to each other and abut up against the edges of adjacent base structures without any gap being formed;

placing the modular turf sections adjacent to and abutting up against each other without any gap being formed to cover the installation area; and individually lifting by hand a selected one of the modular turf sections after having been installed to allow for cleaning, repair, replacement and/or access under the selected one of the modular turf sections.

7. The method of claim 6, wherein the step of cutting includes forming angles or cutouts in one or more of the modular turf sections to conform to the installation area.

* * * * *